US005603309A

United States Patent [19]

Sheliga

[11] Patent Number: 5,603,309

[45] Date of Patent: Feb. 18, 1997

[54] MANUALLY OPERATED ARROW HOLDER AND REPLACER

[76] Inventor: Douglas J. Sheliga, 10216 Kile Rd., Chardon, Ohio 44024

[21] Appl. No.: 529,628

[22] Filed: Sep. 18, 1995

[51] Int. Cl.[6] ..... F41A 9/00

[52] U.S. Cl. ..... 124/44.5; 124/41.1; 124/88

[58] Field of Search ..... 124/44.5, 41.1, 124/24.1, 88, 86

[56] References Cited

U.S. PATENT DOCUMENTS

| | | | |
|---|---|---|---|
| 2,691,974 | 10/1954 | Nelson | 124/44.5 |
| 2,975,780 | 3/1961 | Fisher | 124/24.1 |
| 3,504,659 | 4/1970 | Babington | 424/24.1 |
| 4,685,439 | 8/1987 | Cosentino, Jr. | 124/44.5 |
| 4,686,956 | 8/1987 | Troncoso, Jr. | 124/44.5 |
| 4,703,745 | 11/1987 | Hammond | 124/44.5 |
| 4,803,971 | 2/1989 | Fletcher | 124/44.5 |
| 4,947,823 | 8/1990 | Larson | 124/41.1 |
| 4,949,699 | 8/1990 | Gerber | 124/44.5 |
| 5,009,215 | 4/1991 | Ludwig | 124/44.5 |
| 5,235,958 | 8/1993 | Laffin | 124/44.5 |
| 5,365,912 | 11/1994 | Pittman | 124/44.5 |
| 5,394,858 | 3/1995 | Karolian | 124/44.5 |
| 5,415,154 | 5/1995 | Angeloni | 124/44.5 |
| 5,490,492 | 2/1996 | Savage | 124/44.5 |

*Primary Examiner*—Terry Lee Melius
*Assistant Examiner*—Thomas A. Beach

[57] ABSTRACT

A manually operated arrow holder and replacer is controlled by the fingers of the hand that hold the bow. It is a mechanism consisting of a movable lever that mechanically links to and subsequently moves a replacer into and out of an arrow holding position. In the nonholding position, the replacer acts like a cradle to catch the arrow if it falls off of the arrow rest. While the arrow is in the cradle the archer has the option to move the lever which in turn moves the replacer which can replace the arrow back on the arrow rest.

3 Claims, 6 Drawing Sheets

MANUALLY OPERATED ARROW HOLDER AND REPLACER

BACKGROUND OF THE INVENTION (1) Field of Invention

This invention relates to archery. Specifically, it relates to a new method of replacing the arrow back on the arrow rest if it falls off. As a result the apparatus also functions as a manually controlled arrow holder.

The above is necessary as a result of the high level of accuracy that is being achieved in archery tournaments and bow hunting. The fletching on the arrow strikes the arrow rest as the arrow leaves the bow which results in shooting inaccuracies. To circumvent this, the smallest possible arrow rest is used. Because rests have become so small, the arrow has more of a tendency to fall off. This invention remedies the problem by incorporating a means of putting the arrow back on the rest if it does fall off.

(2) Description of Prior Art

Available to date are arrow holders that hold the arrow on the rest and then swing out of the way when the arrow is drawn in the bow. The disadvantage is as follows:

(A) If while the arrow is drawn in the bow the arrow falls off of the arrow rest, then the bow must be relaxed and both hands moved off of the bow and string to replace the arrow on the arrow rest. It would be nice to be able to replace the arrow on the arrow rest while the arrow is fully drawn in the bow.

SUMMARY OF INVENTION

When an arrow falls off of the arrow rest it will usually land on the bow shelf or the handguard which are under the arrow. This invention acts like a cradle under the arrow that will catch and cradle the arrow. While the arrow is cradled, the archer may rotate the cradle upward which results in putting the arrow back on the arrow rest. The cradle is hereafter referred to as the holder and replacer member.

In general, the manually operated arrow holder and replacer will make the sport of archery more enjoyable. The archer will not have to draw the bow excessively due to the arrow falling off the arrow rest. This allows the archer to use a minimum size arrow rest to reduce deflection caused by the arrow rest to the arrow as the arrow leaves the bow. The feathers of the arrow usually hit the rest, thus a small enough rest may be used that will not touch the feathers as the arrow passes.

The manually operated arrow holder and replacer has the additional advantages following:

A hunter will appreciate the ability to put the arrow back on the rest if a branch or something knocks the arrow-off.

A new archer will appreciate the ability to safely and more easily draw back the arrow in the bow and be confident that the arrow will stay on the rest.

Some heavy bows are harder to draw. The manually operated holder and replacer will give the archer more confidence and enjoyment knowing that the arrow will not fall off the rest and if it does it can be replaced. It is a lot of work to keep drawing a bow and replacing the arrow on the rest if it falls off.

If the manually operated holder and replacer is not moved out of the way before the arrow is shot, the arrow will still fly safely through the manually operated holder and replacer without injury to archer or equipment.

If the holder and replacer member is not moved out of the way before the arrow is shot, the arrow will still fly with slightly reduced accuracy.

BRIEF DESCRIPTION OF THE DRAWINGS

FIG. 6 has three parts that illustrate how the holder and replacer member 10 can lift up an arrow 120 fallen completely off of the rest 101 and replace it back on the rest 101.

DESCRIPTION OF THE PREFERRED EMBODIMENT(S)

The manually operated arrow holder and replacer is manually controlled with the fingers of the left hand (using a right handed archer as an example). The left hand is the hand on the bow. The first finger from the thumb moves a lever that is connected with a cable that subsequently moves the holder and replacer member into and out of the holding position. This is all accomplished while both hands remain on the bow and on the string, with the bow relaxed or fully drawn.

The following numerals represent parts in the figures.

10 Holder and Replacer member
- 10A Arm
- 10B U-shaped portion
- 10C V-shaped portion

11 Replacer Holder

Parts of the hand operable actuator

20 Lever

22 Lever Holder

Parts of the connecting means

30 Cable

32 Cable Holder

The following are not part of this invention. They are mounting and reference parts only. Note these numbers have three digits.

101 Arrow Rest

102 Handguard

110 Bow

120 Arrow

The holder and replacer member 10 and its action is the key to this invention.

Figure 1:
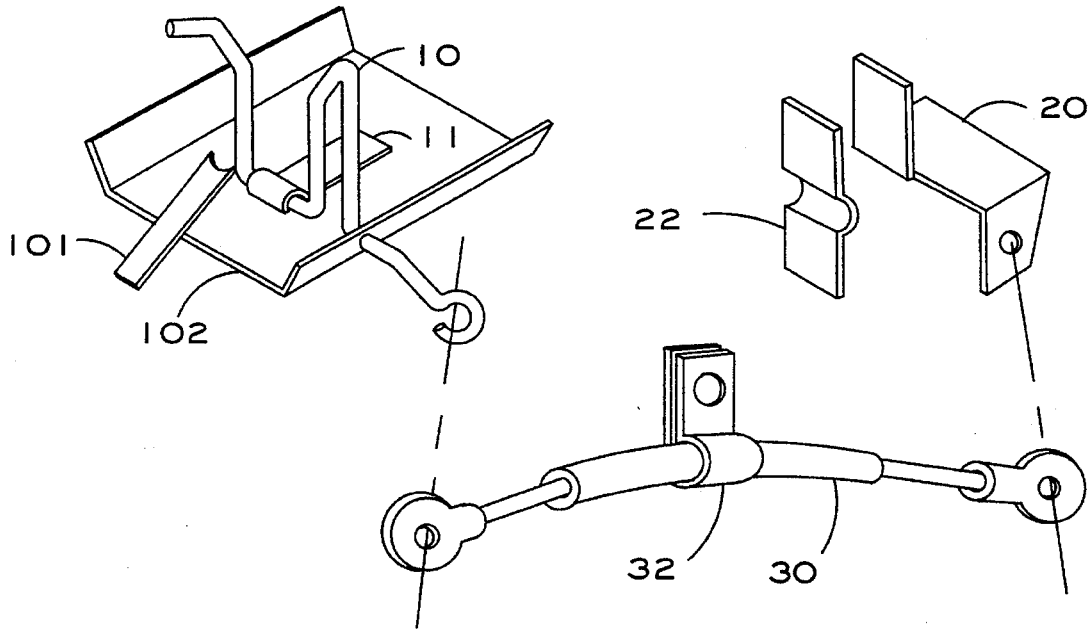
FIG. 1 is an isometric view of the invention's main parts labeled 10, 11, 20, 22, 30, and 32, as they are related to themselves and typical parts of a bow labeled 101 and 102.

FIG. 1 shows the three main parts of the manually operated arrow holder and replacer. The first main part is the holder and replacer member 10. It is shown mounted on a handguard 102. It is held in place by the replacer holder 11. The arrow rest 101 is also shown and is independently mounted. The arrow rest 101 and the handguard 102 are not a part of this invention but they are shown for illustrative purposes only.

The second main part is the lever 20. It is wired, shown in FIG. 5, to the lever holder 22. The lever may have other configurations. Its purpose is to move the cable.

The third main part is the cable 30. It is held in place by the cable holder 32. The cable is like a brake cable on a bicycle. Two parts resembling crimp on electrical lugs are used on the ends of the cable that have holes that match up to the holes in the other parts. Nuts and bolts may be used to loosely fasten the ends of the cable to the lever and holder and replacer member.

Figure 2:
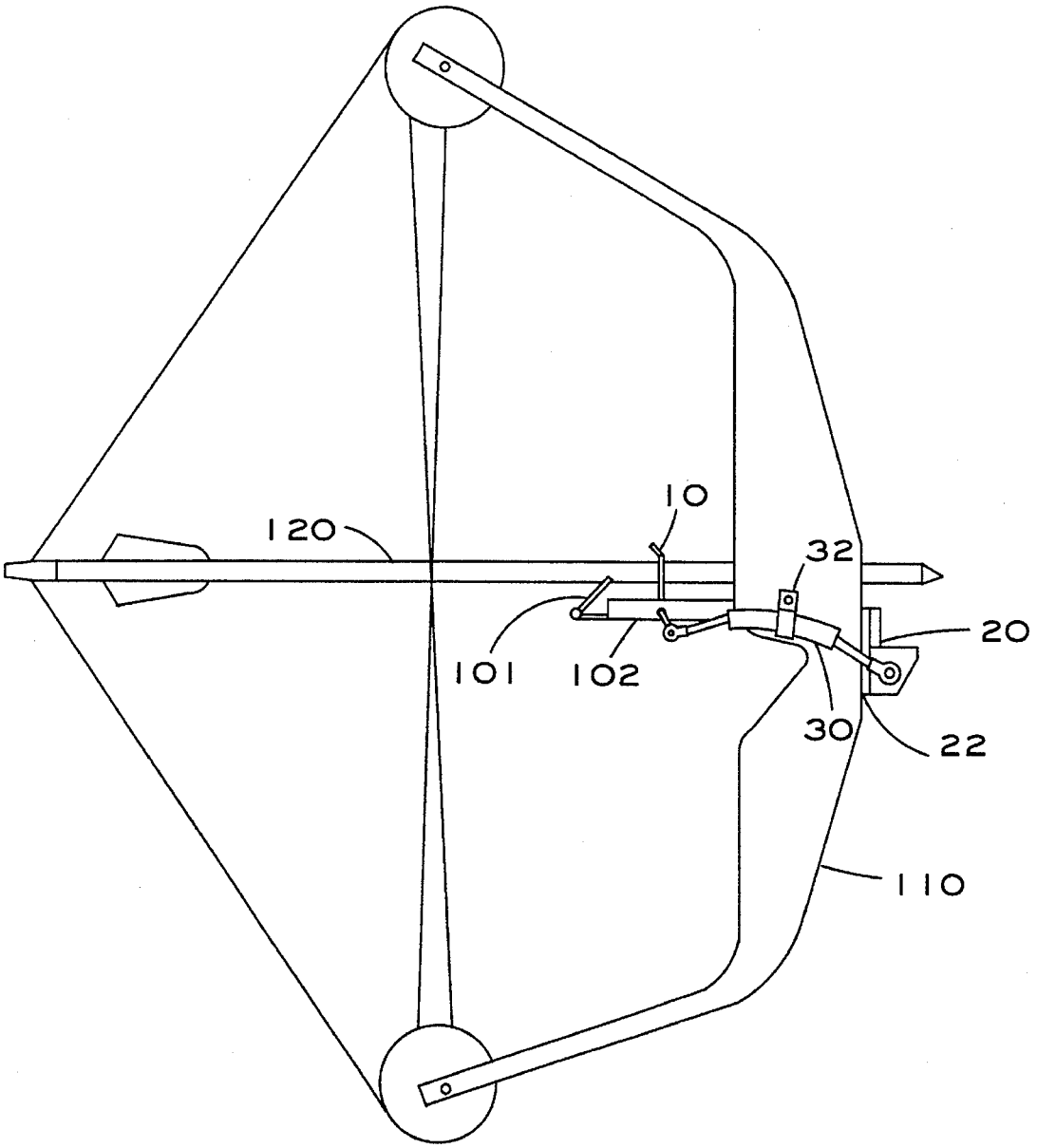
FIG. 2 is a side view of the invention's main parts, labeled 10, 20, 22, 30, and 32, as they would typically mount on a bow.

FIG. 2 shows the configuration of the parts of the manually operated arrow holder and replacer mounted on the bow. The lever holder 22 attaches to the handle of the bow 110 where the lever 20 can be reached by the fingers on the bow hand. The cable holder 32 can be attached to the bow 110 or any accessory in the vicinity. The cable 30 connects the lever 20 with the arm 10A of the holder and replacer member 10. The handguard 102 on which the holder and replacer member 10 is mounted is attached to the bow per its manufacturer's instructions. The handguard 102 is not a part of this invention. It is shown only to illustrate a method of mounting the holder and replacer member 10.

There are many ways to mount the manually operated arrow holder and replacer. Only one typical mounting method and mechanism is shown here.

Refer to FIG. 1 and 2. The lever 20 is moved by the first finger from the thumb on the hand that holds the bow 110. The lever 20 can be moved at full draw, as shown, or with the bow 110 relaxed, not shown.

Figure 3:
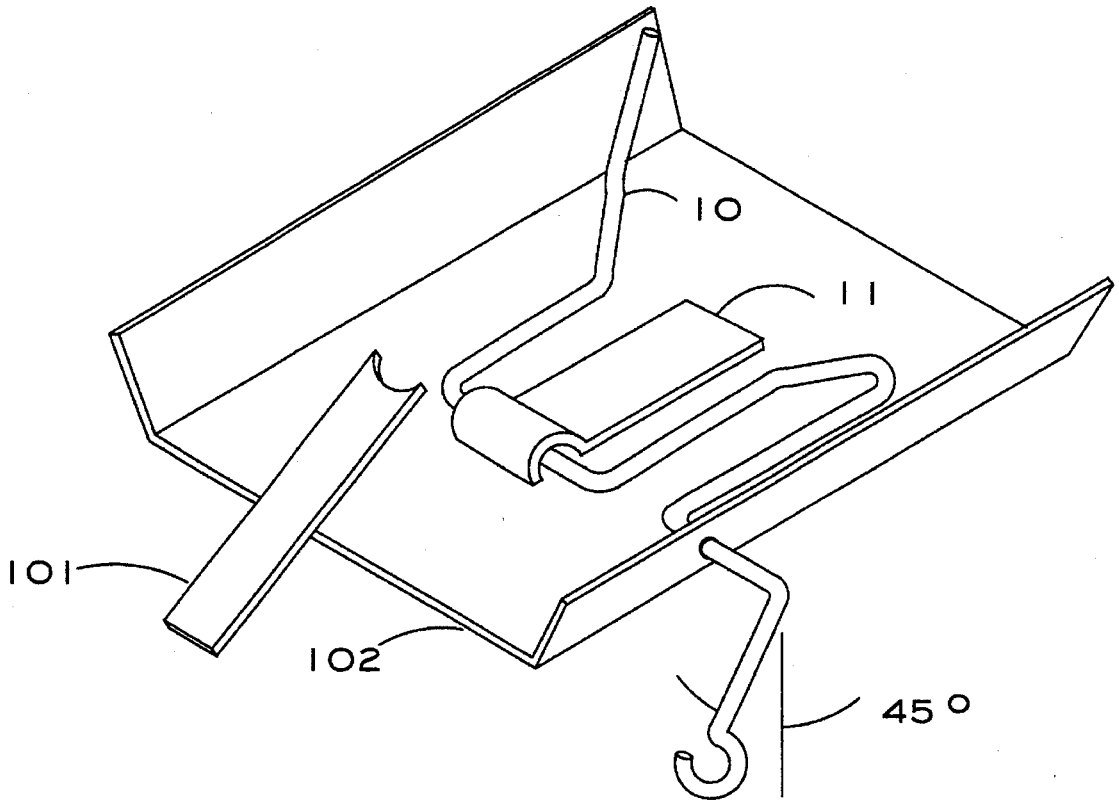
FIG. 3 is an isometric view of the holder and replacer member 10 in the non-holding, or horizontal, position.

As the lever 20 is moved clockwise 90 degrees, it pushes the cable 30. Note the cable can be pushed because it is a bicycle brake type cable and the loading on it is very light. Subsequently, the holder and replacer member 10 moves down 90 degrees to lie flat on the handguard 102. FIG. 3 shows the holder and replacer member flat against the handguard 102. The lever 20 may be moved clockwise and counterclockwise as desired by the archer. FIG. 5 illustrates the end positions of lever movement. The distance the hole In the lever 20 in FIG. 5 moves should be equal to the distance the loop in the arm 10A of the holder and replacer 10 member in FIGS. 3 and 4 moves.

Figure 4:
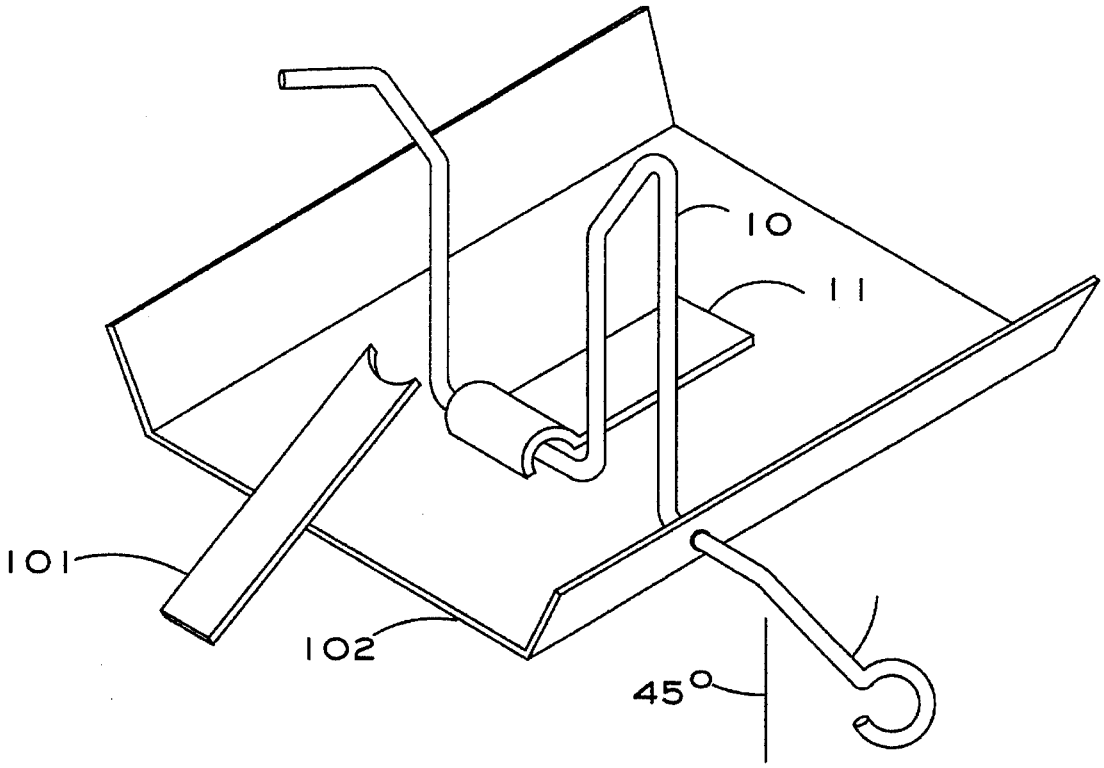
FIG. 4 is an isometric view of the holder and replacer member 10 in the holding, or vertical, position.

Refer to FIGS. 2 and 4. The arrow 120 sits on the arrow rest 101. The holder and replacer member 10 is in the upright position. In the upright position, the holder and replacer member 10 will prevent the arrow 120 from failing off the arrow rest 101. The arrow will touch the holder and replacer member 10 if the arrow moves to the right or left and thus will remain on the arrow rest 101.

Figure 5A:
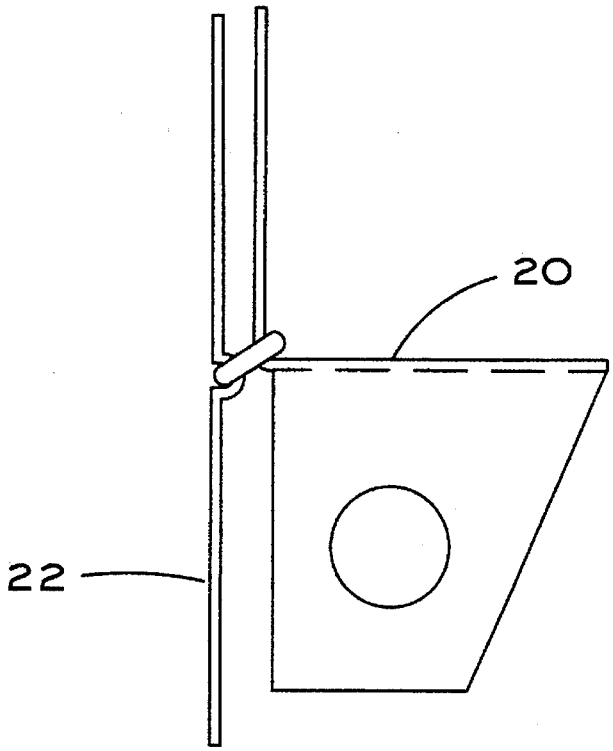
FIG. 5A and 5B are side views of the lever 20 and lever holder 22 illustrating how the hole in the lever 20 moves.
Figure 5B:
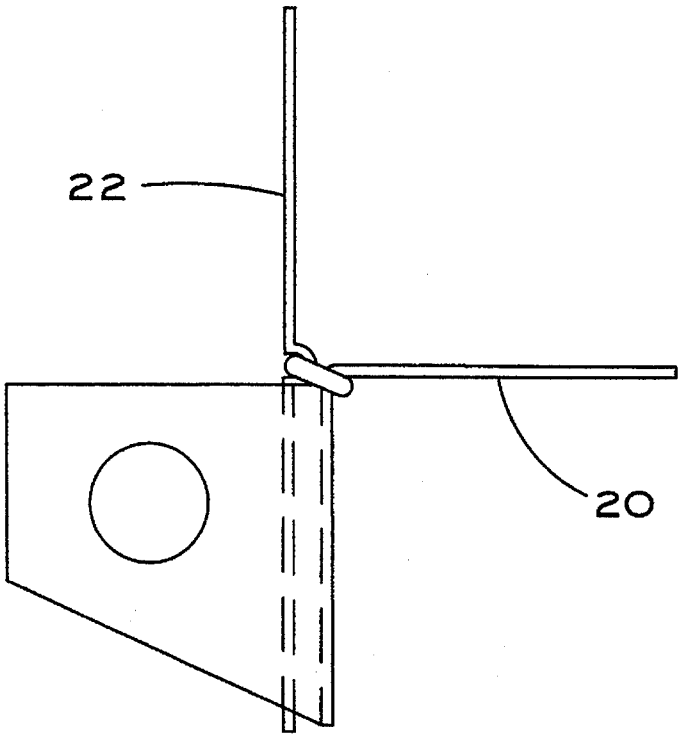

Refer to FIG. 5. The lever 20 is operated by a finger of the bow hand (not shown) to move it between the two positions shown in FIGS. 5A and 5B which respectively correspond to the holding and nonholding, vertical and horizontal positions respectively, of the holder and replacer member 10.

Refer to FIG. 6. If the arrow 120 falls off of the arrow rest 101, it will come to rest on top of the holder and replacer member 10. The shape of the holder and replacer member 10 is such that as it is raised to the upright position, it will return the arrow 120 to rest on the arrow rest 101. The shape is similar to a V whereby the arrow is forced to the bottom and center of the V by gravity. As the V rises above the arrow rest the arrow is forced onto the rest.

More specifically, the holder and replacer member 10 has a U-shaped portion 10B and a V-shaped portion 10C. This is apparent in FIG. 6C. The U-shaped portion 10B is the bottom portion about the arrow rest. The U-shaped portion 10B is a final guide for the arrow to follow when it is being moved onto the rest. The V-shaped portion 10C, top portion of the holder and replacer member 10, is used to cradle the arrow when it falls off the arrow rest and guide it back into the U-shaped portion 10B of the holder and replacer member 10 when moving the arrow onto the rest.

There are some critical dimensions and configurations of the holder and replacer member 10.

Figure 6A:
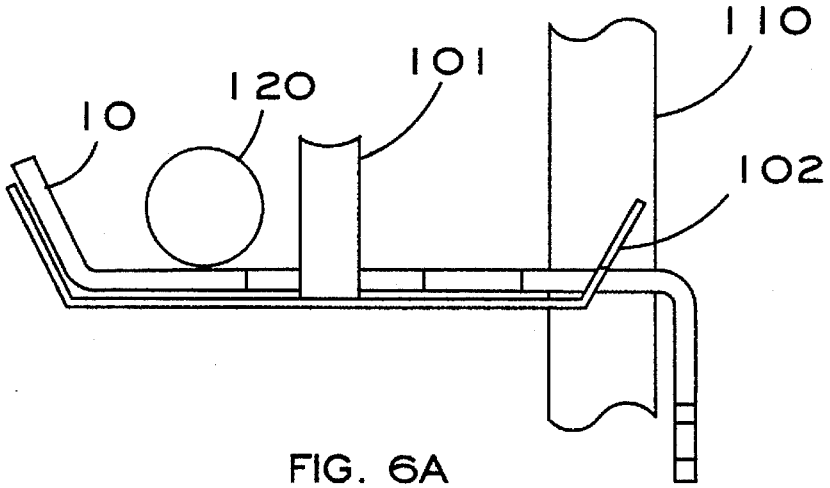
FIG. 6A shows the arrow completely off of the rest 101, but the arrow is cradled by the holder and replacer member 10, on the left side but it could as well landed on the right side.
Figure 6B:
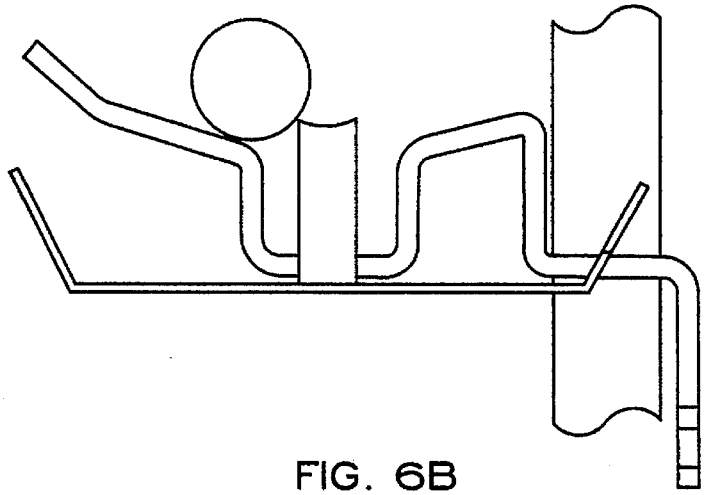
FIG. 6B shows an intermediate position of the holder and replacer member 10 lifting the arrow 120 towards the rest 101.
Figure 6C:
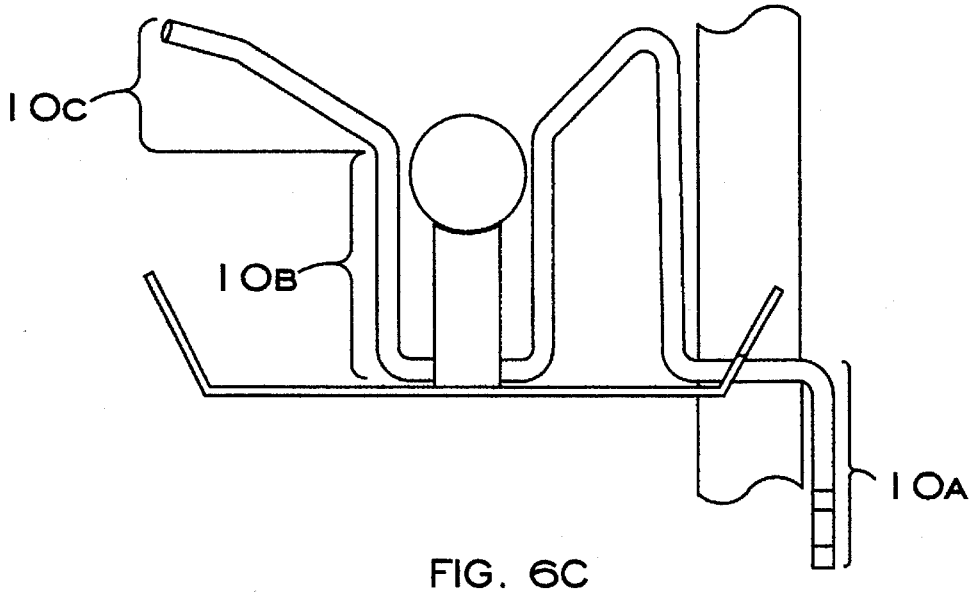
FIG. 6C shows the holder and replacer member 10 in the holding position after it has placed the arrow 120 back on top of the arrow rest 101 and it identifies the three main portions of the holder and replacer member 10: arm 10A, U-shaped portion 10B and V-shaped portion 10C.

Refer to FIG. 6C. Refer to the U-shaped portion 10B of the holder and replacer member 10 on both sides and below the arrow 120. The vertical portions of the holder and replacer member 10 must be less than the radius of the arrow away from the arrow rest 101 so that gravity acting on the center of gravity of the cross section of the arrow will cause the arrow to fall into arrow rest 101.

Refer to FIG. 6C. Refer to the V-shaped portion 10C of the holder and replacer member 10 on both sides and above the arrow 120. The highest right point of the holder and replacer member 10 must be less than the radius of the arrow away from the bow 110 so that gravity acting on the center of gravity of the cross section of the arrow will cause the arrow to fall toward the arrow rest 101. Also note the slope of the left side of the V must also be toward the arrow rest 101.

Refer to FIG. 6A. Refer to the shape of the holder and replacer member 10. The shape is such that it will catch an arrow 120 that has fallen off the arrow rest 101 and confine the arrow 120 until such time the archer decides to put the arrow 120 back on the arrow rest 101.

Refer to FIG. 6B. Refer to the upper slopes of the holder and replacer member 10. As the holder and replacer member 10 is lifted, the upper slopes must be toward the arrow rest 101.

I claim:

1. For use with an archery bow which includes an arrow rest with means on an upper surface thereof to support an arrow extending along an axis, said bow further including a handle, limbs, and a bow string defining a bow plane, a manually operable device to hold said arrow in place on said upper surface of said rest, and to replace said arrow onto said upper surface if said arrow relocates to a laterally displaced position from said rest, said device comprising:

a holder and replacer member, comprising a U-shaped portion and a V-shaped portion both perpendicular to said bow plane when in a horizontal position, whereas said V-shaped portion is above said U-shaped portion when said holder and replacer member is raised to a vertical position;

whereby said U-shaped portion, while in said vertical position will guide said arrow from said laterally displaced position to said arrow rest and constrain said arrow to said arrow rest, and whereby said V-shaped portion will contain said arrow and guide said arrow to said U-shaped portion as said holder and replacer member is being raised to said vertical position;

said arrow rest being located in alignment with said U-shaped portion along said arrow axis;

said holder and replacer member being pivotally mounted to said archery bow about a horizontal axis perpendicular to said arrow axis and positioned under said arrow and in a location near a tip of said arrow when said arrow is in a drawn position, and said holder and replacer member including an arm rigidly attached thereto, and rotatable to pivot said holder and replacer member;

means to selectively position said holder and replacer between said vertical position where said holder and replacer member restrains said arrow from lateral movement to hold said arrow onto said rest, and said horizontal position where said holder and replacer member has no influence on said arrow after said arrow has been released but can cradle and hold said arrow if said arrow relocates to said laterally displaced position from said rest;

said means to selectively position said holder and replacer member comprising a hand operable actuator attached to said bow handle, a connecting means attached between said hand operable actuator and said arm to rotate said arm and thereby selectively position said holder and replacer member.

2. The manually operable device of claim 1 wherein said hand operable actuator is actuated by a lever, pivotally coupled to a lever holder, where said lever holder is attached to said bow handle;

said lever, including an attachment point for said connecting means, pivotally coupled to a lever holder is operated by a finger of the hand that holds said bow handle.

3. The manually operable device of claim 2 wherein said connecting means attached between said hand operable actuator and said arm to rotate said arm comprises a cable and a cable holder.

* * * * *